US011500303B2

(12) United States Patent
Saito et al.

(10) Patent No.: US 11,500,303 B2
(45) Date of Patent: Nov. 15, 2022

(54) IMAGE FORMATION UNIT AND IMAGE FORMATION APPARATUS

(71) Applicant: Oki Electric Industry Co., Ltd., Tokyo (JP)

(72) Inventors: Akira Saito, Tokyo (JP); Hisatoshi Saito, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/401,020

(22) Filed: Aug. 12, 2021

(65) Prior Publication Data

US 2022/0100120 A1 Mar. 31, 2022

(30) Foreign Application Priority Data

Sep. 25, 2020 (JP) ..... JP2020-161491

(51) Int. Cl.
*G03G 15/08* (2006.01)
*G03G 15/06* (2006.01)

(52) U.S. Cl.
CPC ..... *G03G 15/065* (2013.01)

(58) Field of Classification Search
CPC ..... G03G 15/065
USPC ..... 399/107, 110, 111, 113, 285
See application file for complete search history.

(56) References Cited

FOREIGN PATENT DOCUMENTS

| | | | |
|---|---|---|---|
| CN | 107544222 B | * | 9/2020 |
| JP | 2014-10254 A | | 1/2014 |

* cited by examiner

*Primary Examiner* — Hoan H Tran
(74) *Attorney, Agent, or Firm* — Metrolex IP Law Group, PLLC

(57) ABSTRACT

An image formation unit according to an embodiment may include: an image carrier unit in which an image carrier is supported; a developer carrier unit in which a developer carrier is supported; a first bias member provided at one end side in a longitudinal direction of the image formation unit and configured to bias the developer carrier unit toward the image carrier unit; a second bias member provided at the other end side in the longitudinal direction of the image formation unit and configured to bias the developer carrier unit toward the image carrier unit. A first bias direction of biasing the developer carrier unit toward the image carrier unit by the first bias member and a second bias direction of biasing the developer carrier unit toward the image carrier unit by the second bias member are not parallel to each other.

11 Claims, 7 Drawing Sheets

IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2020-161491 filed on Sep. 25, 2020, entitled "IMAGE FORMATION UNIT AND IMAGE FORMATION APPARATUS", the entire contents of which are incorporated herein by reference.

BACKGROUND

The disclosure may relate to an image formation unit and an image formation apparatus.

An electrophotographic image formation apparatus is provided with an image formation unit. The image formation unit includes an image carrier configured to carry a latent image on a surface thereof and a developer carrier configured to carry a developer on a surface thereof. The image formation unit presses the developer carrier against the image carrier to cause the developer carried on the developer carrier to adhere to and develop a latent image carried on the image carrier, thereby forming a developer image on the surface of the image carrier.

In a related art, there is an image formation unit that includes an image carrier unit that holds an image carrier and a developer carrier unit that holds a developer carrier, separately. In this image formation unit, the image carrier unit rotatably supports one end and the other end of the developer carrier unit in a longitudinal direction of the developer carrier unit. Further, the image formation unit is provided with bias members at the one end side and the other end side in the longitudinal direction in such a manner that the bias members are parallel to each other along a guide, so that the bias members bias the developer carrier unit toward the image carrier unit.

Thus, the image formation unit presses the developer carrier unit against the image carrier unit by means of the mutually-paralleled bias members respectively provided at the one end side and the other end side of the longitudinal direction, so that the developer carrier of the developer carrier unit is pressed against the image carrier of the image carrier unit (See, for example, Patent Document 1).

Patent Document 1: Japanese Patent Application Publication No. 2014-10254

SUMMARY

However, the image formation unit may have a problem that the pressing of the developer carrier against the image carrier may not be stable in a case where a mechanism supporting the developer carrier unit provided on the one end side in the longitudinal direction of the image formation unit and a mechanism supporting the developer carrier unit provided on the other end side in the longitudinal direction of the image formation unit are different from each other.

An object of an embodiment may be to propose an image formation unit and an image formation apparatus that are capable of stabilizing pressing of a developer carrier against an image carrier.

A first aspect of the disclosure may be an image formation unit that may include: an image carrier unit in which an image carrier is supported; a developer carrier unit in which a developer carrier is supported; a first bias member provided on one end side of the image formation unit in a longitudinal direction of the image formation unit and configured to bias the developer carrier unit toward the image carrier unit; and a second bias member provided on the other end side of the image formation unit in the longitudinal direction of the image formation unit and configured to bias the developer carrier unit toward the image carrier unit. A first bias direction of biasing the developer carrier unit toward the image carrier unit by the first bias member and a second bias direction of biasing the developer carrier unit toward the image carrier unit by the second bias member are not parallel to each other.

According to the first aspect, an angle existing between the first and second bias directions can stabilize the pressing of the developer carrier unit against the image carrier in such a structure that the mechanisms supporting the developer carrier unit provided at the one end side and the other end side in the longitudinal direction of the image formation unit are different from each other.

A second aspect of the disclosure is an image formation unit that may include: an image carrier unit in which an image carrier is supported; a developer carrier unit in which a developer carrier is supported; a first engagement portion and a second engagement portion provided at one end side in a longitudinal direction of one of the image carrier unit and the developer carrier unit; a third engagement portion provided at the other end side in the longitudinal direction of the one of the image carrier unit and the developer carrier unit; a first engaged portion and a second engaged portion provided at the other of the image carrier unit and the developer carrier unit and configured to be engaged with the first engagement portion and the second engagement portion, respectively; a third engaged portion provided at the other of the image carrier unit and the developer carrier unit and including a guide surface to be engaged with the third engagement portion and to guide the third engagement portion; a first bias member provided on the one end side and configured to bias the developer carrier unit toward the image carrier unit; and a second bias member provided on the other end side and configured to bias the developer carrier unit toward the image carrier unit. A bias direction of biasing the developer carrier unit toward the image carrier unit by the second bias member is inclined with respect to the guide surface of the third engaged portion, and the third engagement portion is located between the first engagement portion and the second engagement portion when viewed in the longitudinal direction.

According to the second aspect, since the direction of biasing the developer carrier unit against the image carrier unit by the second bias member provided on the side having the third engagement portion and the third engaged portion is inclined with respect to the guide surface of the third engaged portion, the pressing of the developer carrier unit against the image carrier unit can be stabilized in such a structure in that the mechanisms (the engagement portions and the engaged portions) supporting the developer carrier unit are differences between the one end side and the other end side in the longitudinal direction of the image formation unit.

According to at least one of the above aspects, the image formation unit and the image formation apparatus capable of stabilizing the pressing of the developer carrier against the image carrier can be realized.

DETAILED DESCRIPTION

Figure 1:
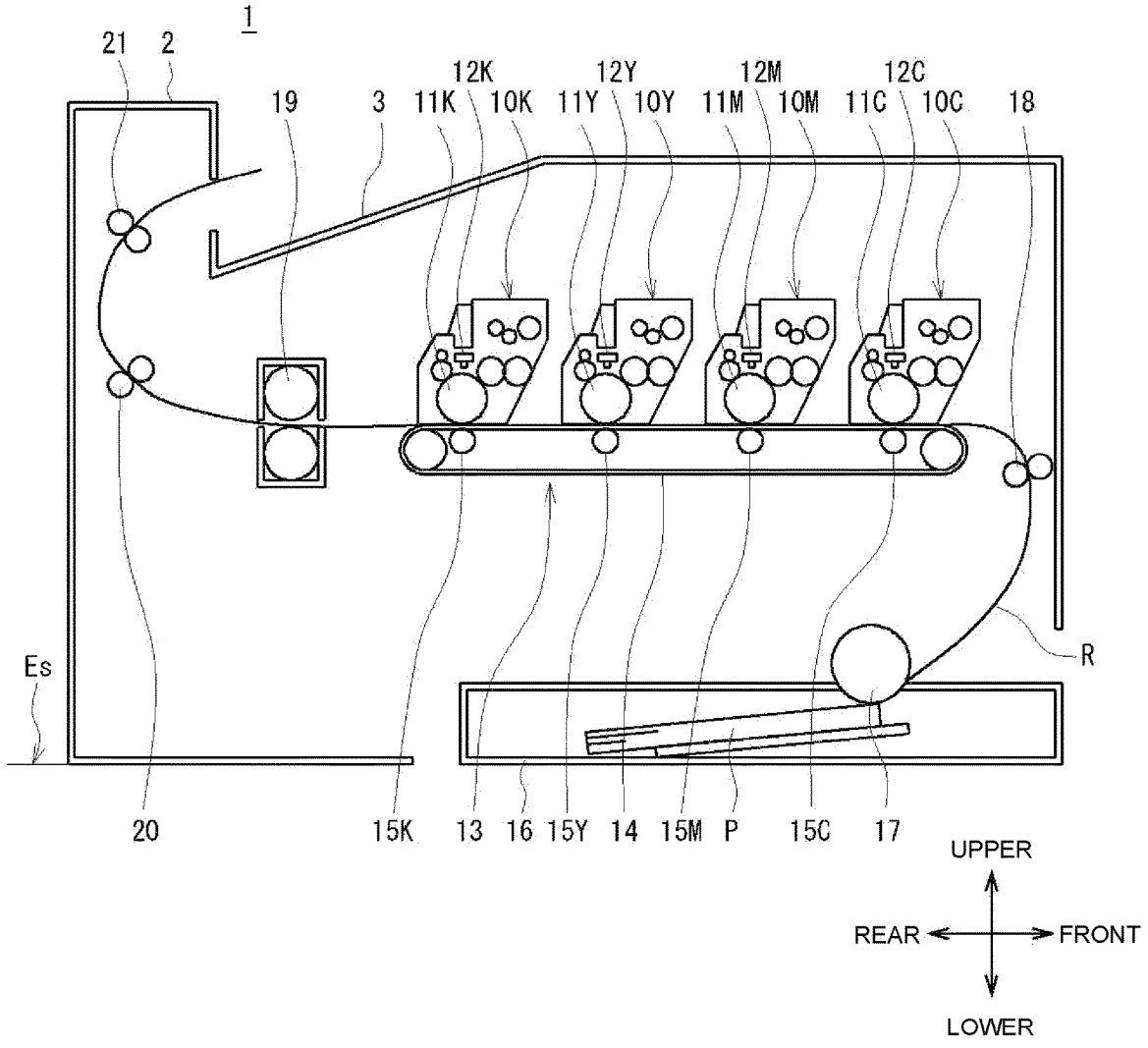
FIG. 1 is a diagram illustrating a view of an internal configuration of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. First Embodiment

[1-1. Configuration of Image Formation Apparatus]

FIG. 1 is a diagram illustrating a configuration of an image formation apparatus 1 according to a first embodiment. Note that FIG. 1 is a cross-sectional side view illustrating an internal configuration of the image formation apparatus 1. As illustrated in FIG. 1, the image formation apparatus 1 includes an apparatus housing 2 formed in a substantially box-shape. Here, a right side of the apparatus housing 2 in FIG. 1 is referred to as a front surface of the apparatus housing 2, a left side of the apparatus housing 2 in FIG. 1 is referred to as a rear surface of the apparatus housing 2, a direction from the front surface to the rear surface of the apparatus housing 2 is referred to as a rear direction, a direction from the rear surface to the front surface of the apparatus housing 2 is referred to as a front direction, a direction from a lower side to an upper side of the apparatus housing 2 is referred to as an upper direction, a direction from the upper side to the lower side of the apparatus housing 2 is referred to as a lower direction, a direction from a front surface side to a back surface side of a drawing sheet of FIG. 1 is referred to as a right direction with respect to the image formation apparatus 1, and a direction from the back surface side to the front surface side of the drawing sheet of FIG. 1 is referred to as a left direction with respect to the image formation apparatus.

The image formation apparatus 1 according to a first embodiment is an electrophotographic color printer and includes a printing mechanism that is provided inside the apparatus housing 2 and configured to convey a medium P such as paper along a conveyance path R while forming (printing) an image on the medium P and discharge the medium having the image thereon onto a stacker cover 3 formed on an upper surface of the apparatus housing 2. Note that a direction orthogonal to a conveyance direction of the medium is a width direction of the medium.

Four image formation units 10 (10K, 10Y, 10M, and 10C), corresponding to developers of respective colors (for example, four color toners of black (K), yellow (Y), magenta (M), and cyan (C)) used in the image formation apparatus 1, are provided at an upper portion in the apparatus housing 2 side by side in the front-rear direction along the conveyance path R.

Each of the image formation units 10 (10K, 10Y, 10M, and 10C) includes a photosensitive drum 11 (11K, 11Y, 11M, and 11C) as an image carrier. Exposure heads 12 (12K, 12Y, 12M, and 12C) such as LED heads are installed above the photosensitive drums 11 (11K, 11Y, 11M, and 11C), respectively. Each image formation unit 10 is a device configured to form an electrostatic latent image by exposing the surface of the photosensitive drum 11 with light by the exposure head 12, and develop the image by attaching the toner as the developer to the electrostatic latent image on the surface of the photosensitive drum 11, thereby forming a toner image on the surface of the photosensitive drum 11.

A transfer unit 13 is provided below the image formation units 10 (10K, 10Y, 10M, and 10C). The transfer unit 13 includes an endless conveyance belt 14 extending along the conveyance path R in the front-rear direction and transfer rollers 15 (15K, 15Y, 15M, and 15C) respectively provided below and opposed to the photosensitive drums 11 (11K, 11Y, 11M, and 11C) with an upper line of the conveyance belt 14 sandwiched between the transfer rollers 15 and the photosensitive drums 11.

The transfer unit 13 is a device configured to transfer the toner images of respective colors formed on the photosensitive drums 11 (11K, 11Y, 11M, and 11C) to the medium P, by conveying the medium P on the conveyance belt 14 to pass the medium P between the upper line of the conveyance belt 14 and the photosensitive drums 11 (11K, 11Y, 11M, and 11C) while charging the transfer rollers 15 (15K, 15Y, 15M, and 15Y) to charge the medium P with a polarity opposite to that of the toner.

Below the transfer unit 13 (i.e., at the lower portion of the apparatus housing 2), a tray 16 is provided to accommodate therein the media P. The media P is contained in the tray 16. A paper feed roller 17 is provided in the vicinity of the tray 16 to feed the media P contained in the tray 16 one sheet at a time into the conveyance path R. On the conveyance path R between the tray 16 and the transfer unit 13, a resist roller 18 is provided to convey the medium P while correcting skew of the medium P.

A fixation device 19 is provided on the conveyance path R at the downstream side in the medium conveyance direction from the transfer unit 13 (that is, the rear side of the transfer unit 13). The fixation device 19 is a device that is configured to fix the toner images on the medium P by heating and pressurizing the medium P as the medium P passes through the fixation device 19. On the conveyance path R at the downstream side in the medium conveyance direction of the fixation device 19 (that is, the rear side of the fixation device 19), discharge rollers 20 and 21 are provided to discharge the medium P on which the toner images have been fixed to the stacker cover 3. The configuration of the image formation apparatus 1 is as described above.

The printing operation of the image formation apparatus 1 is briefly described below. When the image formation apparatus 1 is commanded to print by a control unit (not illustrated), and the like, the paper feed roller 17 and the resist roller 18 conveys the media P contained in the tray 16 to the transfer unit 13 one by one. Each of the image formation units 10 forms an electrostatic latent image by exposing the surface of the photosensitive drum 11 with light by the exposure head 12, and then attaches the toner to the electrostatic latent image on the surface of the photosensitive drum 11, so as to form (develop) the toner image on the surface of the photosensitive drum 11.

The toner images formed on the photosensitive drums 11 are transferred onto the medium P by the transfer unit 13. The medium P on which the toner images have been transferred is conveyed by the transfer unit 13 to the fixation device 19. Then, the fixation device 19 fixes the toner images to the medium P, that is, prints a multi-color image on the medium P. The medium P that has passed through the fixation device 19 (that is, the medium P on which the image has been printed) is discharged by the discharge rollers 20 and 21 to the stacker cover 3. The printing operation of the image formation apparatus 1 is as described above.

[1-2. Internal Configuration of Image Formation Unit].

Next, the internal configuration of the image formation unit 10 (10K, 10Y, 10M, and 10C) is described below in more detail. Since the image formation units 10K, 10Y, 10M and 10C have the same configuration except for the difference in the color of the toner, the internal configuration of only the image formation unit 10K is described below for avoid redundancy.

Figure 2:
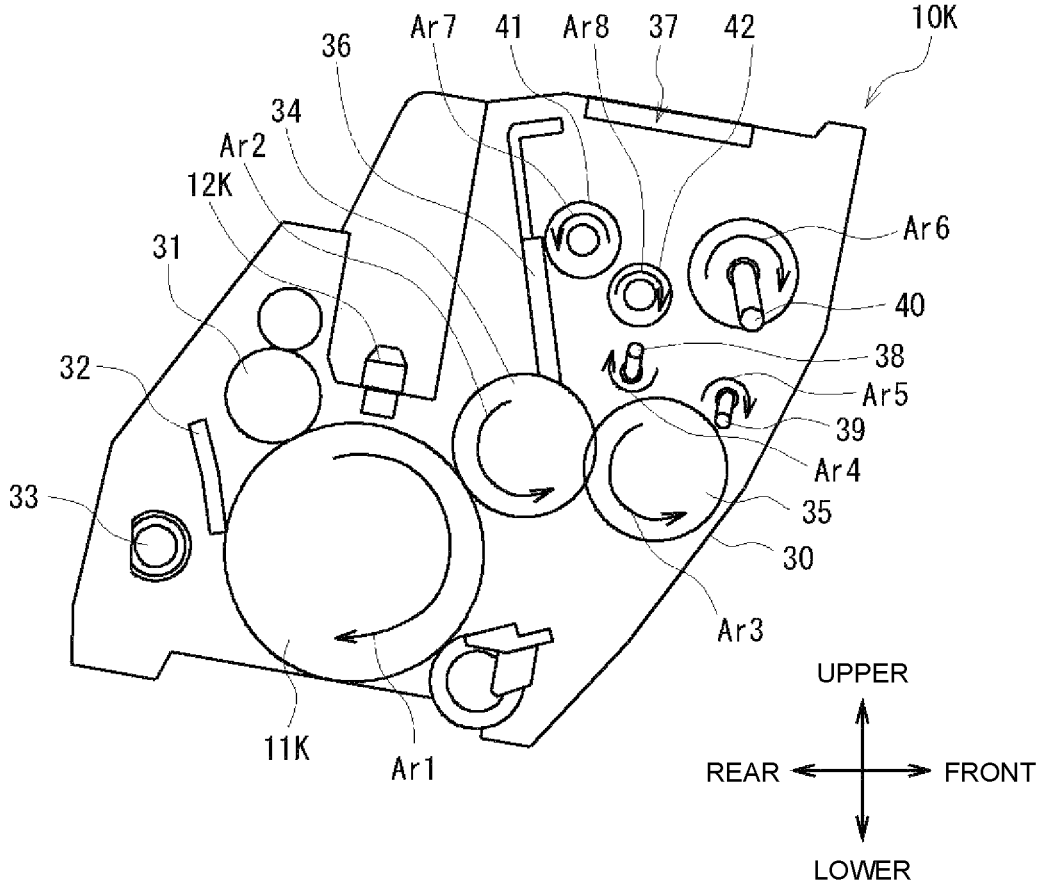
FIG. 2 is a diagram illustrating a view of a configuration of an image formation unit according to a first embodiment.

FIG. 2 is a diagram illustrating the internal configuration of the image formation unit 10K. Note that FIG. 2 is a simplified cross-sectional side view of the internal structure of the image formation unit 10K. The image formation unit 10K includes a housing 30 in which the photosensitive drum 11K is provided. Inside the housing 30, a charging roller 31 and a cleaning blade 32 are provided being in contact with the photosensitive drum 11K. The charging roller 31 is a charging member for uniformly charging the surface of the photosensitive drum 11K. The cleaning blade 32 is a member for removing from the photosensitive drum 11K toner remaining on the photosensitive drum 11K that has not been transferred to the medium P. The charging roller 31 is located downstream of the cleaning blade 32 in the rotation direction of the photosensitive drum 11K (the clockwise direction in FIG. 2) indicated by the arrow Ar1. Inside the housing 30. Further provided in the vicinity of the cleaning blade 32 in the housing 30 is a toner conveying member 33 configured to discharge the toner scraped off the photosensitive drum 11K by the cleaning blade 32.

In the housing 30, a development roller 34 as a developer carrier is provided so as to be in contact with the photosensitive drum 11K. The development roller 34 is located downstream in the rotation direction of the photosensitive drum 11K indicated by the arrow Ar1 from the charging roller 31. Specifically, the charging roller 31 is provided on an upper rear side of the photosensitive drum 11K and the development roller 34 is provided on an upper front side of the photosensitive drum 11K. The rotation direction of the development roller 34 illustrated by the arrow Ar2 (the counterclockwise direction in FIG. 2) is opposite to the rotation direction of the photosensitive drum 11K.

In the housing 30, a supply roller 35 and a development blade 36 are provided so as to be in contact with the development roller 34. The supply roller 35 is a developer supply member for supplying the toner to the development roller 34. The development blade 36 is a member for making the toner supplied to the surface of the development roller 34 a thin layer on the surface of the development roller 34. The development blade 36 is located downstream from the supply roller 35 in the rotation direction of the development roller 34 indicated by the arrow Ar2. Specifically, the development blade 36 is provided above the development roller 34, and the supply roller 35 is provided in front of the development roller 34. The rotation direction of the supply roller 35 (the counterclockwise direction in FIG. 2) indicated by the arrow Ar3 is the same direction as the rotation direction of the development roller 34.

An upper end of the housing 30 is provided with a supply port 37 for supplying the toner contained in a toner cartridge (not illustrated) provided above the housing 30 into the housing 30.

In the housing 30, in an area between the supply port 37 and a pair of the development roller 34 and the supply roller 35 (i.e., in an area where the toner is contained), there are provided with agitation members 38 and 39 for agitating the toner, a remaining amount detection bar 40 for detecting the remaining amount of the toner, and conveyance spirals 41 and 42 for agitating and conveying the toner.

The agitation members 38 and 39 are configured to rotate in rotation directions thereof (the clockwise direction in FIG. 2) indicated by the arrows Ar4 and Ar5, respectively, so as to agitate the toner. The remaining amount detection bar 40 is configured to rotate in a rotation direction thereof indicated by the arrow Ar6 (the clockwise direction in FIG. 2), so as to detect the remaining amount of the toner. The conveyance spirals 41 and 42 configured to rotate in rotation directions indicated by the arrows Ar7 (the counterclockwise direction in FIG. 2) and Ar8 (the clockwise direction in FIG. 2), respectively, so as to agitate and convey the toner. The internal configuration of the image formation unit 10K is as described above.

As illustrated in an exploded view of FIG. 3, the image formation unit 10K is divided into a development unit 100 in which the development roller 34 and the like are supported and a drum unit 200 in which the photosensitive drum 11K (not illustrated in FIG. 3) and the like are supported, and the development unit 100 is supported by the drum unit 200, as will be described in detail later. In the image formation unit 10K, the development unit 100 is biased toward the drum unit 200, and thus the development roller 34 is pressed against the photosensitive drum 11K.

Image forming operations of the image formation units 10 (10K, 10Y, 10M, and 10C) are briefly described below. The image forming operations of the image formation units 10K, 10Y, 10M and 10C are the same, thus, only the image forming operation of the image formation unit 10K is described, for avoiding redundancy.

The image formation unit 10K performs the image forming operation in accordance with control signals transmitted from the control unit (not illustrated). With this control signal, the image formation unit 10K rotates the photosensitive drum 11K in the rotation direction thereof indicated by the arrow Ar1 by a driving force supplied from a drive source (not illustrated) provided in a main body of the image formation apparatus 1. The image formation unit 10K also rotates, by the drive power supplied from the drive source (not illustrated) provided in the main body side of the image formation apparatus 1, the supply roller 35 in the rotation direction thereof indicated by the arrow Ar3, and accordingly rotates the agitation members 38 and 39 in the rotation directions thereof indicated by the arrows Ar4 and Ar5 so as to stir the toner.

With this operation, the toner is supplied to the development roller 34 by the supply roller 35, and the toner supplied to the development roller 34 is thinly layered by the development blade 36 as the development roller 34 rotates with the photosensitive drum 11K in the direction indicated by arrow Ar2. Then, the thinly-layered toner on the development roller 34 is adhered to the electrostatic latent image formed on the photosensitive drum 11K, which has been formed by being exposed by the exposure head 12K, thereby developing the electrostatic latent image with the toner so as to form the toner image on the photosensitive drum 11K.

The toner image formed on the photosensitive drum 11K is transferred to the medium P by the transfer unit 13 (FIG. 1). The toner that is not transferred to the medium P and thus remains on the photosensitive drum 11K is scraped off by the cleaning blade 32 and is then transported by the toner conveying member 33.

When a toner low (a state in which the amount of the toner remaining is low) is detected by the remaining amount detection bar 40 rotating in the rotation direction indicated by the arrow Ar6, the toner is supplied from the supply port 37 to the inside of the image formation unit 10K. The toner supplied from the supply port 37 is agitated and conveyed by the conveyance spirals 41 and 42 rotating in the rotation directions indicated by the arrows Ar7 and Ar8. The image forming operation of the image formation unit 10K is as described above.

[1-3. Support Mechanisms in Image Formation Unit 10]

Next, support mechanisms provided in the image formation unit 10 (10K, 10Y, 10M, and 10C) to support the development unit 100 is described in detail. The support mechanisms of the image formation units 10K, 10Y, 10M and 10C are the same, thus, only the support mechanisms of the image formation unit 10K are described, for avoiding redundancy.

Figure 3:
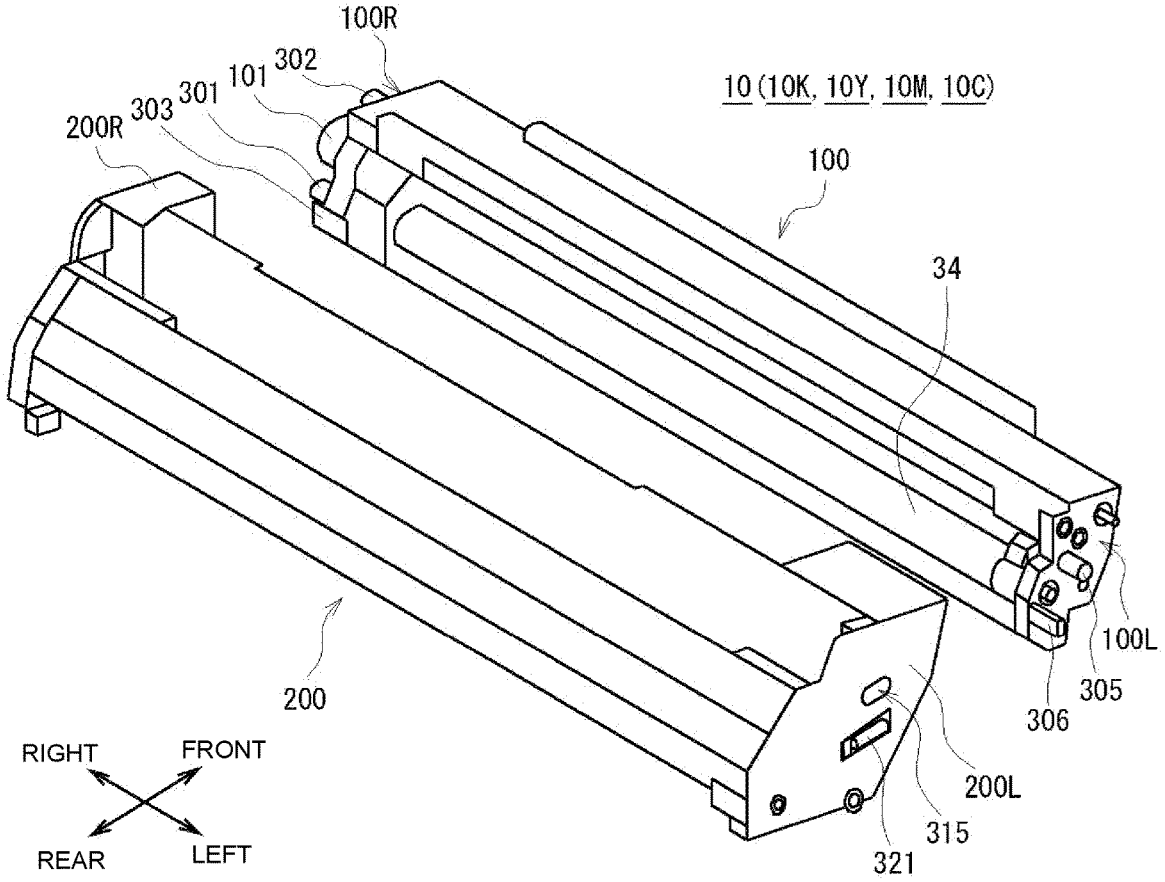
FIG. 3 is a diagram illustrating an exploded perspective view of a configuration of a development unit and a drum unit according to a first embodiment.

As illustrated in FIG. 3, the image formation unit 10K includes the development unit 100 and the drum unit 200. The development unit 100 holds the development roller 34, the supply roller 35, the development blade 36, the supply port 37, the agitation members 38 and 39, the remaining amount detection bar 40, and the conveyance spirals 41 and 42 (see FIG. 2). The drum unit 200 holds the photosensitive drum 11K, the charging roller 31, the cleaning blade 32, and the toner conveying member 33 (see FIG. 2).

The development unit 100 is sandwiched between a front portion of a side wall 200L provided at one end side (left end side) in the longitudinal direction of the drum unit 200 (i.e., in the axial direction of the photosensitive drum 11K) and a front portion of a side wall 200R provided at the other end side (right end side) in the longitudinal direction of the drum unit 200, and is supported by these side walls 200L and 200R.

The development unit 100 includes a drive input shaft 101 configured to input the driving force supplied from the main body of the image formation apparatus 1 to the development unit 100. The drive input shaft 101 is provided at a side surface 100R of the development unit 100 on one end side (right end side) of the longitudinal direction (that is, the axial direction of the development roller 34). The axial direction of the drive input shaft 101 is parallel to the axial direction of the development roller 34. The drive input shaft 101 is provided such that the rotation axis (rotation center) of the drive input shaft 101 coincides with the center of gravity of the development unit 100. The drive input shaft 101 is exposed to the outside of the drum unit 200 through a hole 200H (see FIG. 4A) provided in the side wall 200R on the one end side (right end side) of the drum unit 200 in the longitudinal direction, and connected to the main body of the image formation apparatus 1.

The development unit 100 rotates each rotating member, such as the development roller 34, by the driving force input via the drive input shaft 101. Note that in the following description, the one end side of the longitudinal direction of the development unit 100 (that is, the side on which the drive input shaft 101 is provided) may be referred to as a drive input side or a first side, and the other end side may be referred to as a side opposite from the drive input side or a second side. Similarly, for the image formation unit 10K and the drum unit 200, the one end side in the longitudinal direction may be referred to as the drive input side or the first side and the other end side may be referred to as the side opposite from the drive input side or the second side.

Figure 4B:
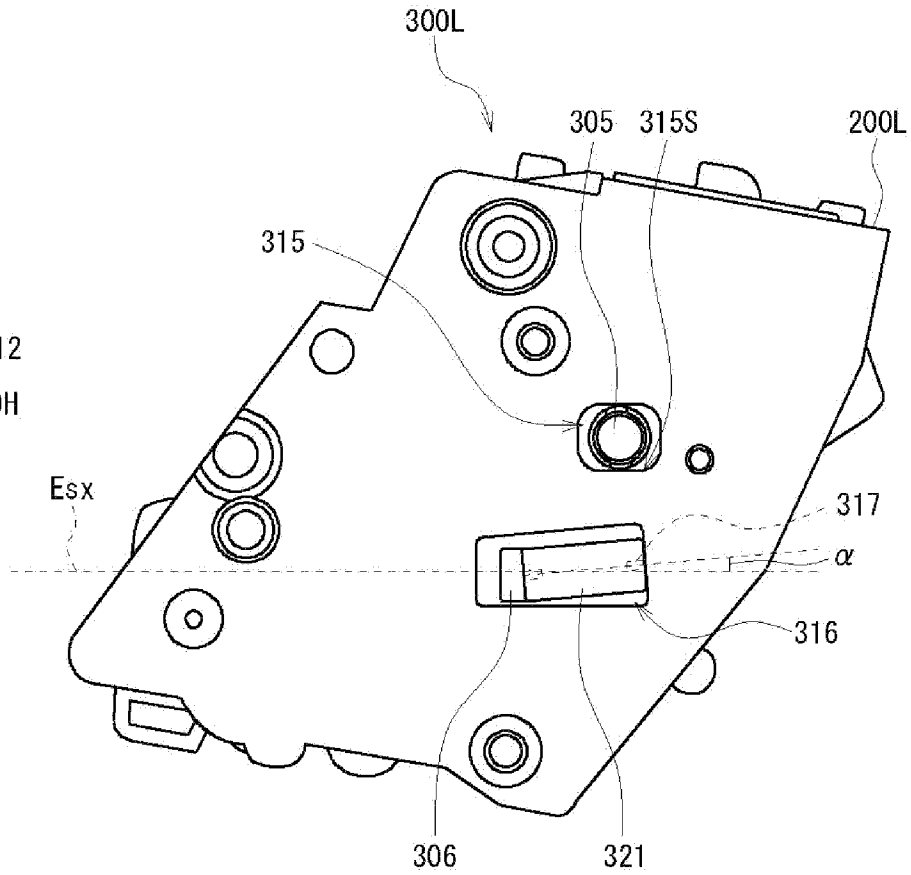
FIGS. 4A and 4B are diagrams illustrating views of configurations of support mechanisms for supporting the development unit according to a first embodiment.
Figure 4A:
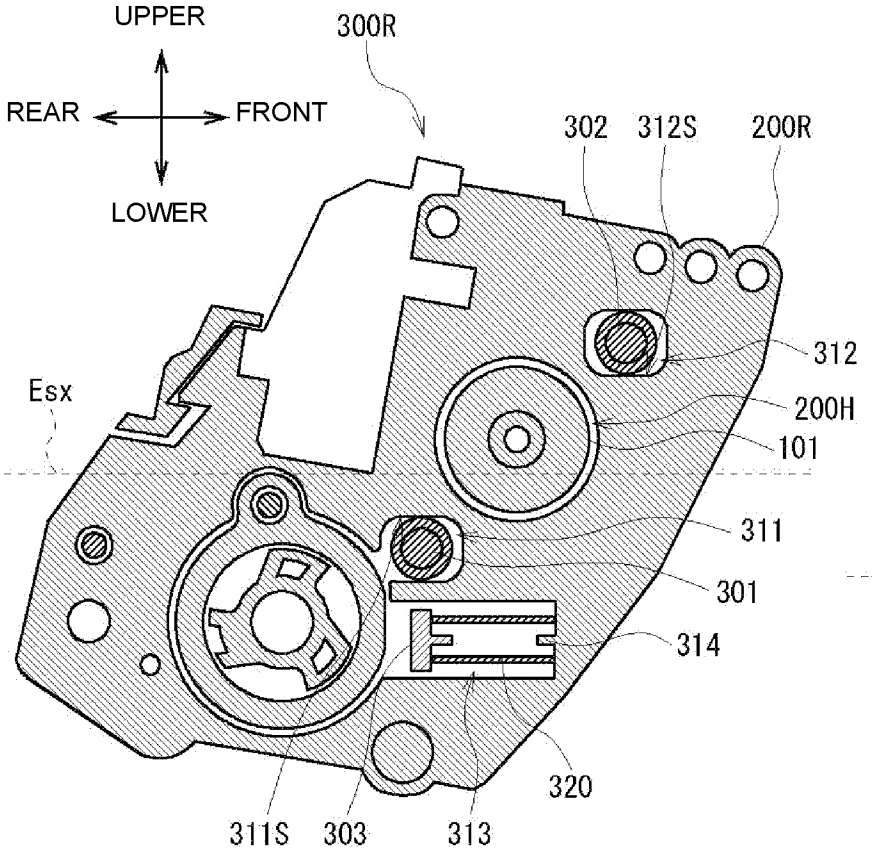

FIG. 4A and FIG. 4B are diagrams illustrating configurations of a first support mechanism 300R provided on the drive input side (right end side) of the image formation unit 10K and a second support mechanism 300L provided on the side (left end side) opposite from the drive input side of the image formation unit 10K. Note that FIG. 4A is a cross-sectional view of the drive input side of the image formation unit 10K, illustrating the configuration of the first support mechanism 300R provided on the drive input side, and FIG. 4B is a side view of the side opposite from the drive input side of the image formation unit 10K, illustrating the configuration of the second support mechanism 300L provided on the side opposite from the drive input side.

First, the configuration of the first support mechanism 300R provided on the drive input side (the first side) is described with reference to FIG. 4A. The first support mechanism 300R includes cylindrical first and second posts 301 and 302 projecting from the side surface 100R (see FIG. 3) on the drive input side (the first side) of the development unit 100, and first and second guide holes 311 and 312 formed in the side wall 200R on the drive input side (the first side) of the drum unit 200.

Figure 5A:
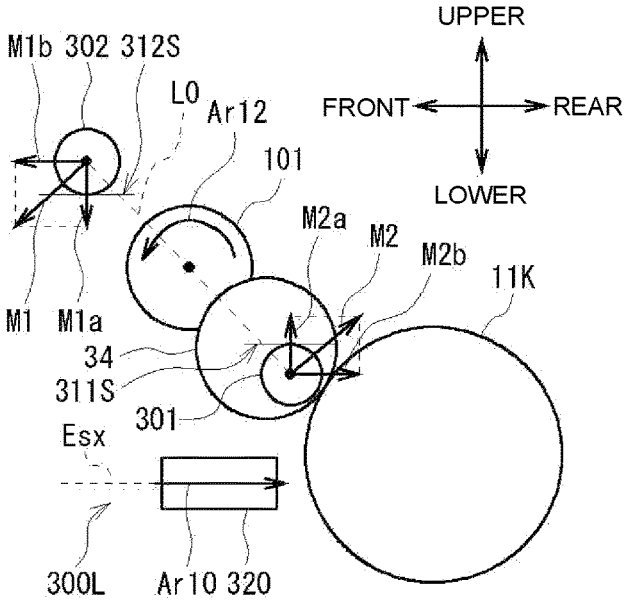
FIGS. 5A and 5B are diagrams illustrating a positional relationship of parts of the support mechanisms according to a first embodiment.

The axial directions of the first post 301 and the second post 302 are parallel to the axial direction of the drive input shaft 101. FIG. 5A illustrates the positional relationship between the first and second posts 301 and 302 and the drive input shaft 101. Note that FIG. 5A is a simplified diagram of the image formation unit 10K viewed from the drive input side, and the orientation of the front-rear direction in FIG. 5A is reversed from that in FIG. 4A. As illustrated in this FIG. 5A, the first post 301 and the second post 302 are arranged in such a manner that the rotation centers (the rotational axes) thereof are equidistant from the rotation center (the rotation axis) of the drive input shaft 101 and in such a manner that the rotation center of the first post 301, the rotation center of the second post 302, and the rotation center of the drive input shaft 101 are located on a straight line L0.

In FIG. 5A, the first post 301 is located in back of the drive input shaft 101 and the second post 302 is located in front of the drive input shaft 101. However, in a case where the first post 301 and the second post 302 are opposed to each other and provided equidistantly from the drive input shaft 101 between the first post 301 and the second post 302, the first post 301 and the second post 302 may be provided at positions different from the positions illustrated in FIG. 5A.

Returning to FIG. 4A, the first guide hole 311 and the second guide hole 312, in which the first post 301 and the second post 302 are to be inserted, are provided at positions opposed to the first post 301 and the second post 302 respectively and are long holes elongated in the front-rear direction. The first guide hole 311 is the elongate hole whose size in a transverse direction (shortitudinal direction) thereof is slightly larger than the diameter of the first post 301. Accordingly, the first guide hole 311 supports the first post 301 in such a manner that the first post 301 is slidable in the longitudinal and transverse directions of the first guide hole 311 in the first guide hole 311. Similarly, the second guide hole 312 is also the elongate hole whose size in a transverse direction (shortitudinal direction) thereof is slightly larger than the diameter of the second post 302. Accordingly, the second guide hole 312 supports the second post 302 in such a manner that the second post 302 is slidable in the longitudinal and transverse directions of the second guide hole 312 in the second guide hole 312.

Thus, by the first post 301 and the second post 302 of the development unit 100 being inserted in the first guide hole 311 and the second guide hole 312 of the drum unit 200, the first support mechanism 300R supports the development unit 100 to be slideable with respect to the drum unit 200 in the front-rear direction and in the vertical direction.

Here, the first guide holes 311 and the second guide holes 312 have their respective longitudinal directions parallel to an apparatus installation surface Es (see FIG. 1) on which the image formation apparatus 1 is installed. Note that, in this example, the apparatus installation surface Es is a horizontal surface, and a virtual plane Esx parallel to the apparatus installation surface Es is illustrated in FIG. 4A. In other words, a first guide surface 311S, which is an upper surface of the first guide hole 311 and is to be in contact with the first post 301, is parallel to the apparatus installation surface Es, and a second guide surface 312S, which is a lower surface of the second guide hole 312 and is to be in contact with the second post 302, is parallel to the apparatus installation surface Es.

The first support mechanism 300R includes a first spring 320 serving as a bias member configured to bias the development unit 100 toward the drum unit 200. The first spring 320, in a compressed state, is fixed at one end thereof to a drum unit side spring fixing portion 314 provided at the front end of a long hole 313 elongated in the front-rear direction and provided in the side wall 200R of the drum unit 200, and is fixed at the other end thereof to a development unit side spring fixing portion 303 protruding from the side surface 100R (see FIG. 3) of the development unit 100 and inserted in the rear end portion of the long hole 313. As a result, the first spring 320 presses the development unit side spring fixing portion 303 in a direction to bring the development unit side spring fixing portion 303 closer to the rear end of the long hole 313, that is, in a direction to bring the development unit 100 closer to the drum unit 200 (rearward).

Thus, the first support mechanism 300R on the drive input side biases the development unit 100 in the direction closer to the drum unit 200 by the first spring 320.

As illustrated in FIG. 5A, the first spring 320 is mounted parallel to the apparatus installation surface Es (virtual plane Esx). Accordingly, the bias direction of the first spring 320 indicated by the arrow Ar10 (i.e., the direction of biasing the development unit 100 toward the drum unit 200) is parallel to the apparatus installation surface Es (the virtual plane Esx). The configuration of the first support mechanism 300R provided on the drive input side is as described above.

Next, the configuration of the second support mechanism 300L provided on the side (the second side) opposite to the drive input side (the first side) is described with reference to FIG. 4B. The second support mechanism 300L includes a cylindrical third post 305 protruding from a side surface 100L (see FIG. 3) of the development unit 100 on the side (the second side) opposite from the drive input side, and a third guide hole 315 formed in the side wall 200L of the drum unit 200 on the side (the second side) opposite from the drive input side.

Figure 5B:
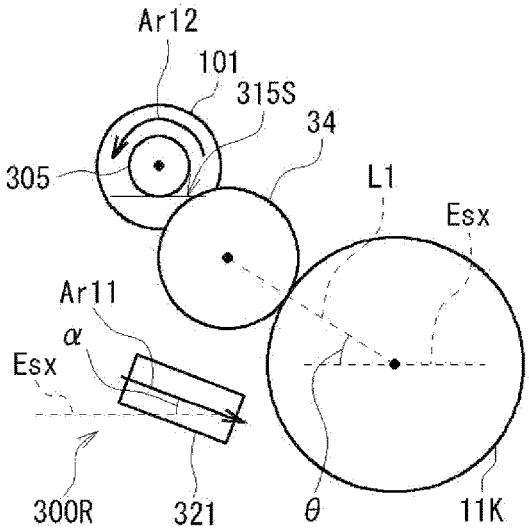

An axial direction of the third post 305 is parallel to the axial direction of the drive input shaft 101. Here, FIG. 5B illustrates the positional relationship between the third post 305 and the drive input shaft 101. FIG. 5B is a simplified diagram of the image formation unit 10K viewed from the side opposite from the drive input side, and the orientation of the front-rear direction in FIG. 5B is reversed from that in FIG. 4B. As illustrated in FIG. 5B, the third post 305 is coaxially provided with the drive input shaft 101 so that the rotation center (the rotation axis) of the third post 305 coincides with the rotation center (the rotation axis) of the drive input shaft 101.

In other words, since the rotation center of the third post 305 coincides with the rotation center of the drive input shaft 101, as illustrated in FIGS. 5A and 5B, the third post 305 is located between the first post 301 and the second post 302 (i.e., located on the straight line L0) when the image formation unit 10K is viewed in the longitudinal direction.

Returning to FIG. 4B, the third guide hole 315, in which the third post 305 is to be inserted, is provided at a position opposed to the third post 305 and is a long hole elongated in the front-rear direction. The third guide hole 315 is the elongate hole whose size in the transverse direction (the shortitudinal direction) is slightly larger than the diameter of the third post 305. In other words, the third guide hole 315 supports the third post 305 in such a manner that the third post 305 is slidable in the longitudinal and transverse directions of the third guide hole 315 in the third guide hole 315.

Thus, the second support mechanism 300L supports the development unit 100 to be rotatable and to be slidable in the front-rear direction and the vertical direction with respect to the drum unit 200, by the third post 305 provided on the drum unit 200 side being inserted in the third guide hole 315 provided on the drum unit 200 side.

Here, the longitudinal direction of the third guide hole 315 is parallel to the apparatus installation surface Es (the virtual surface Esx) on which the image formation apparatus 1 is installed. In other words, a third guide surface 315S, which is a lower surface of the third guide hole 315 and is to be in contact with the third post 305, is parallel to the apparatus installation surface Es.

Further, the second support mechanism 300L includes a second spring 321, which is a bias member to bias the development unit 100 toward the drum unit 200. The second spring 321, in a compressed state, is fixed at one end thereof to a drum unit side spring fixing portion 317 provided at the front end of a long hole 316 elongated in the front-rear direction and provided in the side wall 200L of the drum unit 200, and is fixed at the other end thereof to a development unit side spring fixing portion 306 protruding from the side surface 100L (see FIG. 3) of the development unit 100 and inserted in the rear end portion of the long hole 316. As a result, the second spring 321 presses the developer unit side spring fixing portion 306 in the direction of bringing the developer unit side spring fixing portion 306 closer to the rear end of the long hole 316, that is, in the direction of bringing the developer unit 100 closer to the drum unit 200 (rearward).

Thus, the second support mechanism 300L provided on the side opposite from the drive input side is configured to bias the development unit 100 toward the drum unit 200 by the second spring 321. The magnitude of the bias force exerted by the first spring 320 is equal to the magnitude of the bias force exerted by the second spring 321.

As illustrated in FIG. 5B, the second spring 321 is not parallel to the apparatus installation surface Es (the virtual surface Esx), but is mounted at an angle α with respect to the apparatus installation surface Es (the virtual surface Esx) so that the rear end of the second spring 321 (the side of the second spring closer to the photosensitive drum 11K) is positioned lower than the front end of the second spring. As a result, the bias direction of the second spring 321 illustrated by the arrow Ar11 (i.e., the bias direction of biasing the development unit 100 toward the drum unit 200) is inclined by the angle α with respect to the apparatus installation surface Es (the virtual plane Esx) toward the direction of gravity. The angle α satisfies $0°<\alpha<\theta$, wherein the angle θ is an angle between the apparatus installation surface Es (virtual surface Esx) and the straight line L1 passing through the rotation center of the development roller 34 and the rotation center of the photosensitive drum 11K.

Here, the difference between the angle θ and the angle α is set to, for example, 0° to 30°, and the angle α is set to, for example, 5° to 30°, on the premises that the rotation center of the development roller 34 is located above the rotation center of the photosensitive drum 11K. Specifically, for example, the angle θ is set to 35 degrees and the angle α is set to 10 degrees. The configuration of the second support mechanism 300L provided on the side opposite to the drive input side is as described above.

As described above, the first support mechanism 300R and the second support mechanism 300L have the configurations different from each other, and the first support mechanism 300R supports the development unit 100 at two points, which are the first post 301 and the second post 302, while the second support mechanism 300L supports the development unit 100 at one point, which is the third post 305.

The reason for supporting the development unit 100 at a total of three points, including the two points on the drive input side and the one point on the side opposite to the drive input side, is to stably support the development unit 100 at the three points while canceling the rotational moment generated in the development unit 100 at the two points on the drive input side.

[1-4. Operations of Support Mechanisms]

Next, operations of the first support mechanism 300R and second support mechanism 300L are described with reference to FIGS. 5A, 5B, 6A and 6B. FIG. 5A mainly relates to operations of the first post 301 and the second post 302 of the first support mechanism 300R, and FIG. 6A mainly relates to an operation of the first spring 320 of the first support mechanism 300R. FIG. 5B mainly relates to an operation of the third post 305 of the second support mechanism 300L, and FIG. 6B is a diagram mainly relates to an operation of the second spring 321 of the second support mechanism 300L.

As illustrated in FIGS. 5A and 5B, during the operation of the image formation unit 10K, the driving force is transmitted to the drive input shaft 101 to rotate the drive input shaft 101 in the rotation direction (the counterclockwise direction in the figures) indicated by the arrow Ar12.

At this time, a rotational moment M1 in the rotation direction indicated by the arrow Ar12 is applied to the first post 301. Similarly, a rotational moment M2 in the rotation direction indicated by the arrow Ar12 is applied to the second post 302. That is, a rotational force is applied to rotate the development unit 100 in the rotation direction illustrated by the arrow Ar12 about the third post 305, which is provided on the same axis as the drive input shaft 101.

At this time, as illustrated in FIG. 5A, the rotation of the development unit 100 is regulated by the first post 301 and the second post 302 contacting the first guide surface 311S and the second guide surface 312S, respectively.

Here, a vertical component (the component orthogonal to the first guide surface 311S and the apparatus installation surface Es) of the rotational moment M1 at the first post 301 is referred to as a vertical moment M1*a*, and a horizontal component (the component parallel to the first guide surface 311S and the apparatus installation surface Es) at the first post 301 is referred to as a horizontal moment M1, while a vertical component of the rotation moment M2 at the second post 302 is referred to as a vertical direction moment M2*a* and a horizontal component of the rotation moment M2 at the second post 302 is referred to as a horizontal direction moment M2*b*.

Since the first post 301 and the second post 302 are opposed to each other and provided equidistantly from the drive input shaft 101 between the first post 301 and the second post 302, the vertical moment M1*a* applied to the first post 301 and the vertical moment M2*a* applied to the second post 302 are of the same magnitude and in opposite directions. Similarly, the horizontal moment M1*b* applied to the first post 301 and the horizontal moment M2*b* applied to the second post 302 are of the same magnitude and in opposite directions. For this reason, the rotational moment M1 at the first post 301 and the rotational moment M2 at the second post 302 cancel each other.

On the other hand, as illustrated in FIG. 5B, since the third post 305 is coaxially provided with the drive input shaft 101, no apparent rotational moment occurs at the third post 305.

As a result, the rotational moment applied to the development unit 100 is apparently canceled out. Therefore, as illustrated in FIGS. 6A and 6B, in the state where the development unit 100 is biased toward the drum unit 200, forces applied to the contact position P1 between the development roller 34 and the photosensitive drum 11K are only a force (i.e., the bias force) F1 generated by the first spring 320, a force (i.e., the bias force) F2 generated by the second spring 321, and a force (i.e., the gravity) F3 generated by the weight of the development unit 100.

In other words, the development roller 34 is pressed against the photosensitive drum 11K by these three forces (the bias force F1, the bias force F2, and the gravity F3) applied to the contact position P1. As illustrated in FIG. 6B, the contact position P1 between the development roller 34 and the photosensitive drum 11K is located at 90-θ degrees away from the uppermost position of the circumference of the photosensitive drum 11K in the rotation direction of the photosensitive drum 11K indicated by the arrow Ar1.

Figure 6A:
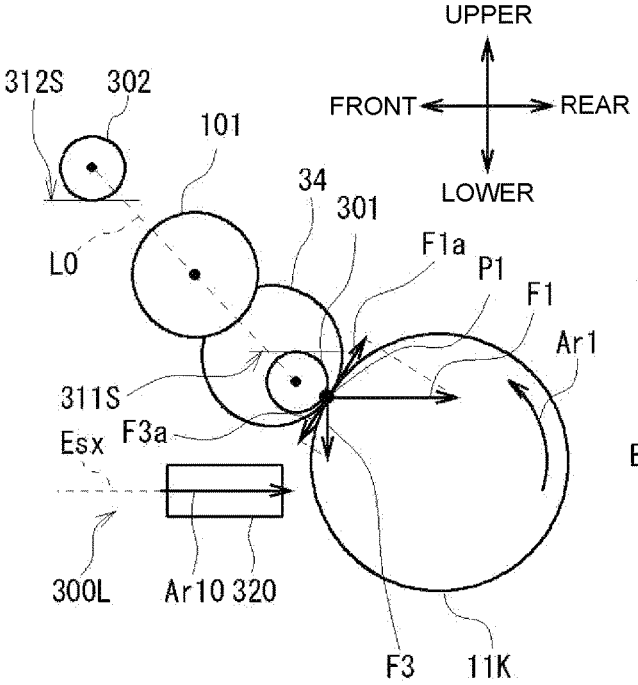
FIGS. 6A and 6B are diagrams illustrating magnitudes and directions of forces applied to a contact position between a development roller and a photosensitive drum according to a first embodiment.
Figure 6B:
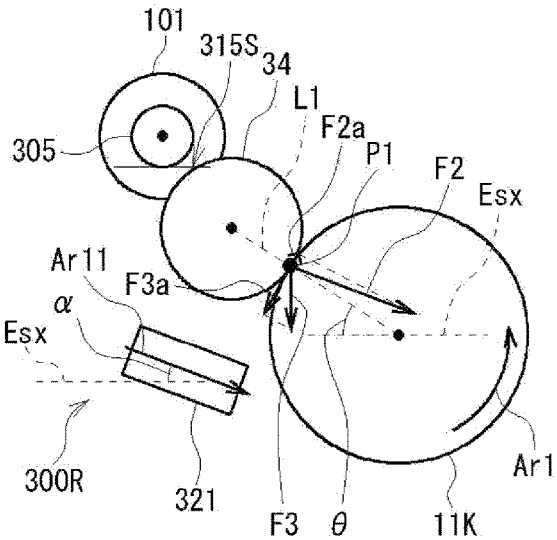

As illustrated in FIGS. 6A and 6B, the forces applied to the contact position P1 on the drive input side are different from the forces applied to the contact position P1 on the side opposite from the drive input side. As illustrated in FIG. 6A, on the drive input side, the bias force F1 of the first spring 320 and the gravity F3 of the development unit 100 are applied to the contact position P1. The direction of the bias force F1 is parallel to the apparatus installation surface Es, and the direction of the gravity F3 is orthogonal to the apparatus installation surface Es. That is, the bias force F1 is orthogonal to the gravity F3.

Note that a component of the bias force F1 parallel to the tangent line passing through the contact position P1 is referred to as a tangential component F1*a* of the bias force F1, and a component of the gravity F3 parallel to the tangent line passing through the contact position P1 is referred to as a tangential component F3*a* of the gravity F3. The tangential component F1*a* of the bias force F1 and the tangential component F3*a* of the gravity F3 are opposite to each other. That is, the tangential component F1*a* of the bias force F1 is a force to push up the development unit 100 along the tangent line passing through the contact position P1, and the tangential component F3*a* of the gravity F3 is a force to push down the development unit 100 along the tangent line passing through the contact position P1.

In a first embodiment, the tangential component F1*a* of the bias force F1 is larger than the tangential component F3*a* of the gravity F3. Therefore, the development unit 100 tries to move in the direction (upward) indicated by the tangential component F1*a*, but the first post 301 and the second post 302 are in contact with the first guide surface 311S and the second guide surface 312S, respectively, so that the movement (that is, lifting) of the development unit 100 is restricted.

As illustrated in FIG. 6A, the first support mechanism 300R on the drive input side is configured such that the rotation axis of the development roller 34 and the rotation axis of the photosensitive drum 11K are parallel to each other when the first post 301 and the second post 302 contact the first guide surface 311S and the second guide surface 312S, respectively. In other words, the first support mechanism 300R is configured such that the development roller 34 is stably pressed against the photosensitive drum 11K while keeping the development roller 34 and the photosensitive drum 11K parallel to each other by the first post 301 and the second post 302 being in contact with the first guide surface 311S and the second guide surface 312S, respectively.

On the other hand, as illustrated in FIG. 6B, on the side opposite from the drive input side, the bias force F2 of the second spring 321 and the gravity F3 of the development unit 100 are applied to the contact position P1. The direction of the bias force F2 is inclined by the angle $\alpha$ with respect to the apparatus installation surface Es (the virtual surface Esx) toward the direction of gravity.

Note that the component of the bias force F2 parallel to the tangent line passing through the contact position P1 is referred to as a tangential component F2*a* of the bias force F2. The tangential component F2*a* of the bias force F2 and the tangential component F3*a* of the gravity F3 are opposite to each other. That is, the tangential component F2*a* of the bias force F2 is a force to push up the development unit 100 along the tangent line passing through the contact position P1, and the tangential component F3*a* of the gravity F3 is the force to push down the development unit 100 along the tangent line passing through the contact position P1. On the side opposite from the drive input side, the direction of the bias force F2 is inclined with respect to the installation surface Es (virtual surface Esx) by the angle $\alpha$ toward the direction of gravity. Thus, the tangential component F2*a* of the bias force F2 on the side opposite from the drive input side is smaller than the tangential component F1*a* of the bias force F1 on the drive input side.

Figure 7:
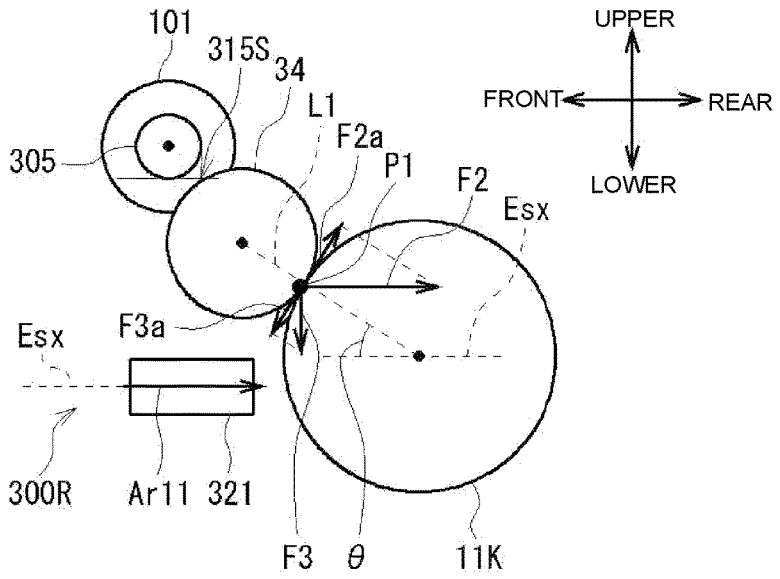
FIG. 7 is a diagram illustrating magnitudes and directions of forces applied to a contact position between a development roller and a photosensitive drum according to a comparative example.

By the way, FIG. 7 illustrate a comparative example. As illustrated in FIG. 7, in a case where, on the side opposite from the drive input side, the direction of the bias force of the second spring 321 is parallel to the apparatus installation surface Es (the virtual surface Esx), the tangential component F2*a* of the bias force F2 of the second spring 321 becomes larger than the tangential component F3*a* of the gravity F3 as in the drive input side and thus the development unit 100 tries to move from the contact position P1 in the direction (upward) indicated by the tangential component F2*a*. With this configuration of the comparative example, on the side opposite from the drive input side, the third post 305 gets separated away from the third guide surface 315S, which is provided below the third post 305, so that movement (that is, lifting) of the development unit 100 cannot be regulated.

Further, the second support mechanism 300L is configured such that the rotation axis of the development roller 34 and the rotation axis of the photosensitive drum 11K are parallel to each other when the third post 305 contacts the third guide surface 315S, as illustrated in FIG. 6B. Therefore, if the third post 305 gets separated from the third guide surface 315S, the rotation axis of the development roller 34 and the rotation axis of the photosensitive drum 11K cannot be kept parallel, and the development roller 34 cannot be stably pressed against the photosensitive drum 11K.

That is, on the side opposite from the drive input side, it may be preferable to satisfy that the tangential component F2*a* is equal or less than the tangential component F3*a* in order to stably press the development roller 34 against the photosensitive drum 11K while keeping the rotation axis of the development roller 34 and the rotation axis of the photosensitive drum 11K parallel.

In light of this, in the second support mechanism 300L according to a first embodiment, as illustrated in FIG. 6B, the direction of the bias force applied by the second spring 321 is set to be inclined with respect to the apparatus installation surface Es (the virtual plane Esx) by the angle $\alpha$ toward the direction of gravity. Therefore, the tangential component F2*a* of the bias force F2 applied by the second spring 321 in the second support mechanism 300L according to a first embodiment is smaller than that in the comparative example where the direction of the bias force F2 is set to be parallel to the apparatus installation surface Es (the virtual plane Esx), and is smaller than the tangential component F1*a* of the bias force F1 applied by the first spring 320. Further, in a first embodiment, the value of the angle $\alpha$ is set in a range of $0<\alpha<\theta$, to make the tangential component F2*a* equal to or less than the tangential component F3*a*.

With the configuration, on the side opposite from the drive input side of the image formation unit 10K, the second support mechanism 300L can prevent the development unit 100 from being lifted up. Therefore, the development roller 34 can be stably pressed against the photosensitive drum 11K while keeping the rotation axis of the development roller 34 and the rotation axis of the photosensitive drum 11K parallel.

Note that in as a first embodiment, the angle $\theta$ is set at 35 degrees and the angle $\alpha$ is set at 10 degrees as described above, but when considering making the tangential component F2*a* as small as possible, it may be preferable that the angle $\alpha$ is closer to the angle $\theta$.

4. Effects

As described above, in the image formation unit 10 according to the first embodiment includes: the drum unit 200 serving as the image carrier unit that holds the photosensitive drum 11 serving as the image carrier; the development unit 100 serving as the developer carrier unit that holds the development roller 34 serving as the developer carrier; the first spring 320 serving as the first bias member provided at the one end side (the drive input side) of the longitudinal direction of the image formation unit 10 and configured to bias the development unit 100 toward the drum unit 200; and the second spring 321 serving as the second bias member provided at the other end side (the side opposite from the drive input side) of the longitudinal direction of the image formation unit 10 and configured to bias the development unit 100 toward the drum unit 200, wherein the bias direction of biasing the development unit 100 toward the drum unit 200 by the first spring 320 (the first bias direction) and the bias direction of biasing the development unit 100 toward the drum unit 200 by the second spring 321 (the second bias direction) are not parallel to each other.

Therefore, the angle (angle α) between the direction of biasing the development unit 100 toward the drum unit 200 by the first spring 320 and the direction of biasing the development unit 100 toward the drum unit 200 by the second spring 321 can stabilize the pressing of the development roller 34 against the photosensitive drum 11 in such a structure where the support mechanism (the first support mechanism 300R) supporting the development unit 100 on the drive input side is different from the support mechanism (the second support mechanism 300L) supporting the development unit 100 on the side opposite from the drive input side.

In other words, the image formation unit 10 according to the first embodiment includes: the first post 301 serving as the first engagement portion and the second post 302 serving as the second engagement portion provided at the one end side (the drive input side) of the longitudinal direction of the development unit 100; the third post 305 serving as the third engagement portion provided at the other end side (the side opposite from the drive input side) of the longitudinal direction of the development unit 100; the first guide hole 311 serving as the first engaged portion provided at the drum unit 200; the second guide hole 312 serving as the second engaged portion provided at the drum unit 200; the third guide hole 315 serving as the third engaged portion provided at the drum unit 200 and including the third guide surface 315S; the first spring 320 serving as the first bias member provided on the drive input side; and the second spring 321 serving as the second bias member provided on the side opposite from the drive input side, wherein the direction of biasing the development unit 100 against the drum unit 200 by the second spring 321 is inclined with respect to the third guide surface 315S of the third guide hole 315, and the third post 305 is positioned between the first post 301 and the second post 302 when the development unit 100 is viewed in the longitudinal direction.

Accordingly, the direction of biasing the development unit 100 against the drum unit 200 by the second spring 321 provided on the side opposite from the drive input side is inclined with respect to the third guide surface 315S of the third guide hole 315, so that the pressing of the development roller 34 against the photosensitive drum 11 can be stabilized in such a structure where the support mechanisms (the first support mechanism 300R and the second support mechanism 300L) supporting the development unit 100 are different between the drive input side and the side opposite from the drive input side of the development unit 100.

Further, the image formation unit 10 according to a first embodiment includes the third guide surface 315S serving as the lower surface of the third guide hole 315, which is parallel to the apparatus installation surface Es.

The image formation unit 10 is configured to bias the development unit 100 toward the drum unit 200 so as to press the development roller 34 against the photosensitive drum 11 and is configured such that the rotation center of the development roller 34 is located above the rotation center of the photosensitive drum 11.

The image formation unit 10 is configured so that the bias direction of biasing the development unit 100 toward the drum unit 200 by the first spring 320 is parallel to the third guide surface 315S (i.e., parallel to the apparatus installation surface Es), whereas the bias direction of biasing the development unit 100 toward the drum unit 200 by the second spring 321 is inclined with respect to the third guide surface 315S (i.e., the apparatus installation surface Es) by an angle α toward the direction of gravity. The angle α is set to be greater than 0 and less than the angle θ ($0° < \alpha < \theta$), wherein the angle θ is the angle between the apparatus installation surface Es and the straight line L1 passing through the rotation center of the development roller 34 and the rotation center of the photosensitive drum 11.

With this configuration, it is possible that, on the side opposite from the drive input side, the magnitude of the tangential component F2*a* of the bias force F2 of the second spring 321 applied to the contact position P1 between the development roller 34 and the photosensitive drum 11 is equal to or less than the tangential component F3*a* of the gravity F3 of the weight of the development unit 100 applied to the contact position P1.

Accordingly, the image formation unit 10 can prevent the development unit 100 from being lifted on the side opposite from the drive input side because the third post 305 contacts the third guide surface 315S. As a result, the development roller 34 can be stably pressed against the photosensitive drum 11K while maintaining the rotation axis of the development roller 34 and the rotation axis of the photosensitive drum 11K parallel to each other. Thus, the image formation unit 10 can stabilize the pressing of the development roller 34 against the photosensitive drum 11 in such a structure that the support mechanism (the first support mechanism 300R) supporting the development unit 100 on the drive input side and the support mechanism (the second support mechanism 300L) supporting the development unit 100 on the side opposite from the drive input side are different from each other.

2. Second Embodiment

Next, a second embodiment is described. In a second embodiment, configurations of support mechanisms that supports the development unit 100 differs from that in a first embodiment described above. Accordingly, only the configurations of the support mechanisms according a second embodiment is described below, for avoiding redundant explanations.

Figure 8A:
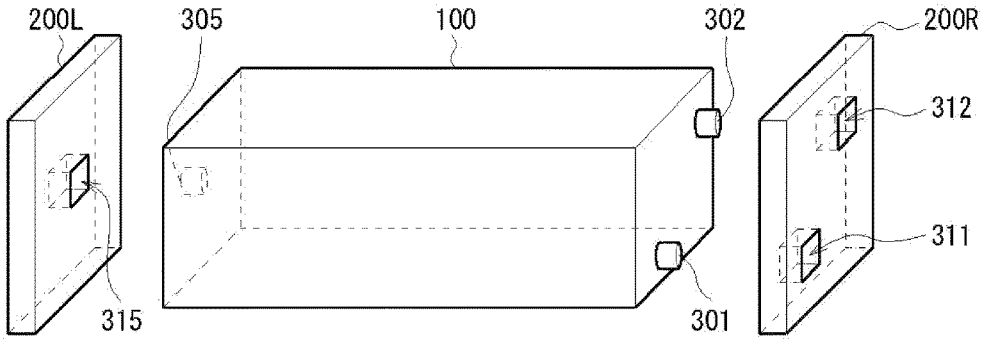
FIGS. 8A and 8B are diagrams illustrating differences between the support mechanisms according to a first embodiment and support mechanisms according to a second embodiment.

FIG. 8A illustrates the first support mechanism 300R provided on the drive input side and the second support mechanism 300L provided on the side opposite from the drive input side according to a first embodiment. FIG. 8A is a diagram of a simplified perspective view illustrating the first support mechanism 300R and the second support mechanism 300L. As illustrated in FIG. 8A, the first support mechanism 300R according to a first embodiment described above includes the first post 301 and the second post 302 provided at the development unit 100, and the first guide hole 311 and the second guide hole 312 provided at the side wall 200R of the drum unit 200. The second support mechanism 300L according to a first embodiment described above includes the third post 305 provided at the development unit 100 and the third guide hole 315 provided at the side wall 200L of the drum unit 200.

Figure 8B:
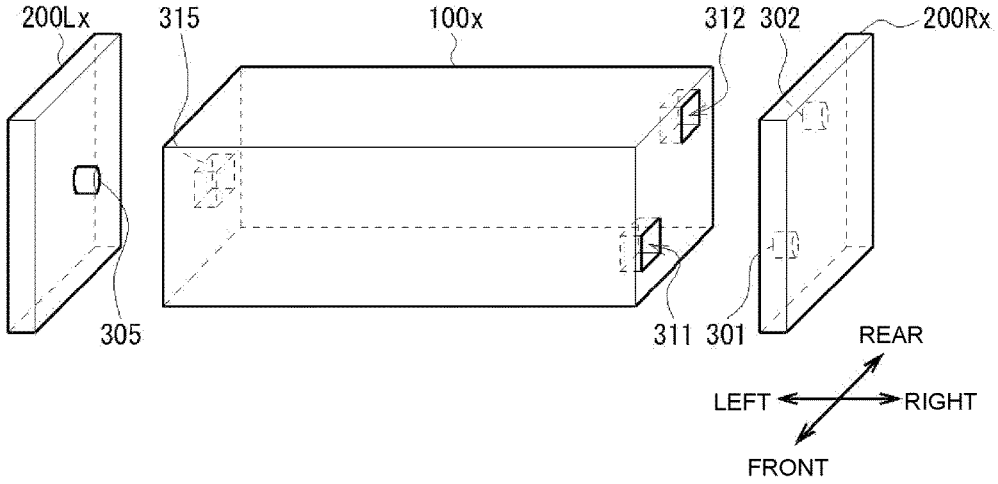

FIG. 8B illustrates a first support mechanism 300Rx provided on the drive input side and a second support mechanism 300Lx provided on the side opposite from the drive input side according to a second embodiment. As illustrated in this FIG. 8B, in the first support mechanism 300Rx according a second embodiment, a first post 301 and a second post 302 are provided at the side wall 200R of the drum unit 200 rather than at the development unit 100, and a first guide hole 311 and a second guide hole 312 are provided at the development unit 100 rather than at the side wall 200R of the drum unit 200. In the second support mechanism 300Lx according to a second embodiment, a third post 305 is provided at the side wall 200L of the drum unit 200 rather than at the development unit 100, and a third guide hole 315 is provided at the development unit 100 rather than at the side wall 200L of the drum unit 200.

Thus, the first support mechanism 300Rx and the second support mechanism 300Lx according to a second embodiment function in the same manner as the first support mechanism 300R and the second support mechanism 300L according to a first embodiment described above, although the arrangements of the posts and the guide hole according to a second embodiment are reversed with respect to these in a first embodiment. Therefore, a second embodiment can achieve the same effects as a first embodiment.

Note that in first and second embodiments described above, the two posts and the two guide holes are provided on the drive input side, and the one post and the one guide hole are provided on the side opposite from the drive input side. The disclosure is not limited thereto. For example, one post and one guide hole may be provided on the drive input side and two posts and two guide holes may be provided on the side opposite from the drive input side.

3. Other Embodiments

[3-1. Modification 1]

In a first embodiment described above, the case has been described in which the second spring 321 provided in the second support mechanism 300L is mounted at the angle α with respect to the apparatus installation surface Es, so that the tangential component F2*a* of the bias force F2 applied to the contact position P1 between the development roller 34 and the photosensitive drum 11 is less than the tangential component F3*a* of the gravity force F3 applied to the contact position P1, so as to prevent the development unit 100 from being lifted.

Figure 9:
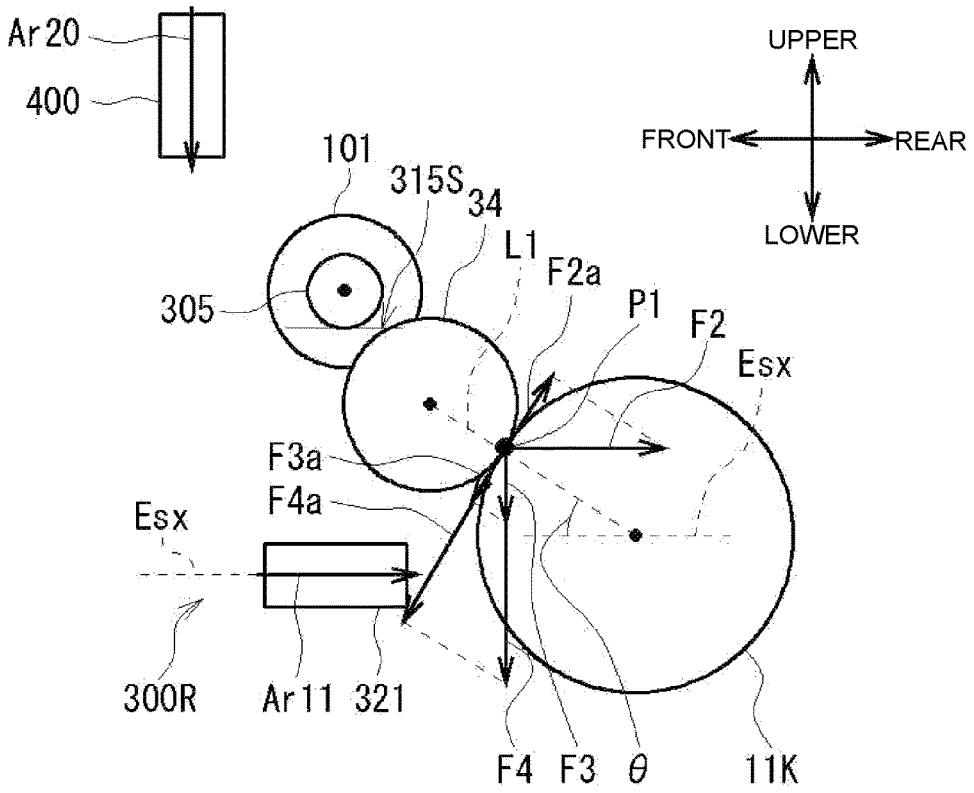
FIG. 9 is a diagram illustrating a view of configurations of support mechanisms according to another embodiment.

However, the disclosure is not limited thereto. For example, in a modification, as illustrated in FIG. 9, the second spring 321 (in this case, serving as a third bias member) provided in the second support mechanism 300L may be mounted along (i.e., parallel to) the apparatus installation surface Es (the virtual surface Esx) so that the bias direction of the second spring 321 be set along (i.e., parallel to) the apparatus installation surface Es (the virtual plane Esx), and a third spring 400 (in this case, serving as a second bias member) may be newly added to the second support mechanism 300L.

The third spring 400 is mounted along the gravity direction orthogonal to the apparatus installation surface Es (i.e., at an inclination of 90 degrees toward the gravity direction from the apparatus installation surface Es). The third spring 400, in a compressed state, has an upper end thereof fixed to the drum unit 200 and a lower end thereof fixed to the development unit 100. As a result, the bias direction of the third spring 400, indicated by the arrow Ar20, is in the direction (i.e., the direction of gravity) orthogonal to the apparatus installation surface Es.

In this case, the contact position P1 between the development roller 34 and the photosensitive drum 11 is subjected to the bias force F2 of the second spring 321, the gravity F3 of the development unit 100, and the bias force F4 of the third spring 400. Here, a tangential component F4*a* of the bias force F4 is in the same direction as the tangential component F3*a* of the gravity F3. The tangential component F2*a* of the bias force F2 is larger than the tangential component F3*a* of the gravity F3, and is smaller than the sum of the tangential component F3*a* and the tangential component F4*a* of the bias force F4. That is, the following equation is satisfied: $F2a \leq F3a + F4a$.

Thus, by adding the third spring 400 that biases the development unit 100 in the direction of gravity, the tangential component of gravity at the contact position P1 can be increased, so that the development unit 100 can be prevented from being lifted without tilting the second spring 321 with respect to the apparatus installation surface Es.

Here, the third spring 400 is provided in the second support mechanism 300L of the image formation unit 10. However, the disclosure is not limited thereto. In the disclosure, the third spring 400 may be provided, for example, in the main body of the image formation apparatus 1. In this case, for example, when the image formation unit 10 is installed in the main body of the image formation apparatus 1, the third spring 400 contacts the development unit 100 and pushes the development unit 100 in the direction of gravity.

[3-2. Modification 2]

Figure 10:
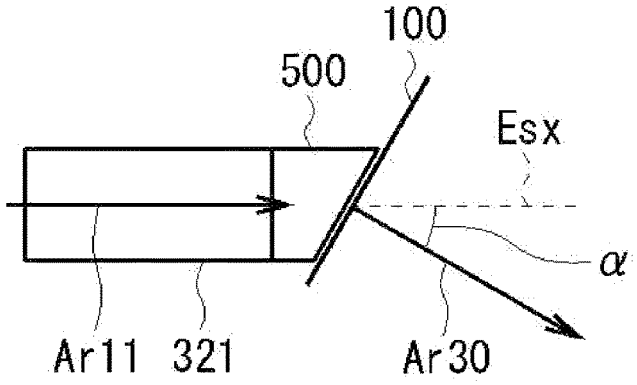
FIG. 10 is a diagram illustrating a view of another embodiment in which a direction of a bias force is inclined with respect to a direction of a spring.

In a first embodiment described above, the case has been described in which the second spring 321 in the second support mechanism 300L is mounted at the angle α with respect to the apparatus installation surface Es, so that the bias direction of biasing the development unit 100 toward the drum unit 200 by the second spring 321 is inclined by the angle α with respect to the apparatus installation surface Es. In other words, in a first embodiment described above, the extending direction of the second spring 321 is inclined by the angle α with respect to the apparatus installation surface Es, so that the direction of biasing the development unit 100 toward the drum unit 200 by the second spring 321 is inclined by the angle α with respect to the apparatus installation surface Es However, the disclosure is not limited thereto. For example, in a modification, as illustrated in FIG. 10, the extending direction of the second spring 321 indicated by the arrow Ar11 is set parallel to the apparatus installation surface Es, an end of the second spring 321 in the extending direction is in contact with the development unit 100 and thus serves as a contact portion 500, and the contact portion 500 of the second spring 321 and a portion of the development unit 100 in contact with the contact portion 500 are inclined at the angle α with respect to the apparatus installation surface Es (the virtual surface Esx). In this structure, even though the extending direction of the second spring 321 remains parallel to the apparatus installation surface Es, the direction of biasing the development unit 100 toward the drum unit 200 by the second spring 321, indicated by the arrow Ar30, can be set to be inclined by the angle α with respect to the apparatus installation surface Es.

[3-3. Modification 3]

In embodiments described above, the case has been described in which the first and second coil springs 320 and 321 are used as examples of the first and second bias members. However, the disclosure is not limited thereto. For example, bias members other than a coil spring such as plate springs or the like may be used. Similarly, regarding to the third spring 400, a bias member other than a coil spring may be used

[3-4. Modification 4]

Furthermore, the disclosure is not limited to each of above-described embodiments and modifications. That is, the application range of the invention covers embodiments and modifications obtained by arbitrarily combining some of or all of embodiments and modifications described above well as embodiments and modifications obtained by extracting some of embodiments and modifications described above.

The disclosure can be widely used, for example, in an electrophotographic image formation apparatus.

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation unit comprising:

an image carrier unit in which an image carrier is supported;

a developer carrier unit in which a developer carrier is supported;

a first bias member provided on one end side of the image formation unit in a longitudinal direction of the image formation unit and configured to bias the developer carrier unit toward the image carrier unit; and a second bias member provided on the other end side of the image formation unit in the longitudinal direction of the image formation unit and configured to bias the developer carrier unit toward the image carrier unit, wherein a first bias direction of biasing the developer carrier unit toward the image carrier unit by the first bias member and a second bias direction of biasing the developer carrier unit toward the image carrier unit by the second bias member are not parallel to each other.

2. The image formation unit according to claim 1, wherein one of the image carrier unit and the developer carrier unit is provided with a first engagement portion and a second engagement portion on the one end side in the longitudinal direction thereof and with a third engagement portion on the other end side in the longitudinal direction thereof, the other of the image carrier unit and the developer carrier unit is provided with a first engaged portion to be engaged with the first engagement portion, a second engaged portion to be engaged with the second engaged portion, and a third engaged portion including a guide surface to be engaged with and to guide the third engagement portion, and the second bias direction is inclined with respect to the guide surface of the third engaged portion, and the third engagement portion is located between the first engagement portion and the second engagement portion when viewed in the longitudinal direction.

3. The image formation unit according to claim 2, wherein the first bias direction is parallel to the guide surface of the third engaged portion.

4. The image formation unit according to claim 2, wherein the developer carrier unit includes a drive input shaft configured to input a driving force from an outside to rotate the developer carrier, wherein the drive input shaft is provided parallel to a rotation axis of the developer carrier, the first engagement portion and the second engagement portion are opposed to each other at equal distances from the drive input shaft provided between the first engagement portion and the second engagement portion, and the third engagement portion is coaxially provided with the drive input shaft.

5. The image formation unit according to claim 4, wherein the guide surface of the third engaged portion is provided at a lower portion of the third engaged portion and is parallel to an apparatus installation surface to which an image formation apparatus that holds the image formation unit is installed.

6. The image formation unit according to claim 5, wherein the developer carrier is pressed against the image carrier by biasing the developer carrier unit toward the image carrier unit, a rotation center of the developer carrier is located above a rotation center of the image carrier, and the second bias direction is inclined with respect to the apparatus installation surface toward the direction of gravity.

7. The image formation unit according to claim 6, wherein the second bias direction is inclined with respect to the apparatus installation surface by an angle $\alpha$ toward the direction of gravity, and the angle $\alpha$ is greater than 0 degrees and less than an angle $\theta$, wherein the angle $\theta$ is an angle between the apparatus installation surface and a straight line passing through the rotation center of the developer carrier and the rotation center of the image carrier.

8. The image formation unit according to claim 6, further comprising:

a third bias member provided on the other end side of the longitudinal direction of the image formation unit and configured to bias the developer carrier unit toward the image carrier unit, wherein the third bias member is provided along the apparatus installation surface and the second bias member is provided along a gravity direction orthogonal to the apparatus installation surface.

9. An image formation apparatus comprising the image formation unit according to claim 1.

10. An image formation unit comprising:

an image carrier unit in which an image carrier is supported;

a developer carrier unit in which a developer carrier is supported;

a first engagement portion and a second engagement portion provided at one end side in a longitudinal direction of one of the image carrier unit and the developer carrier unit;

a third engagement portion provided at the other end side in the longitudinal direction of the one of the image carrier unit and the developer carrier unit;

a first engaged portion and a second engaged portion provided at the other of the image carrier unit and the developer carrier unit and configured to be engaged with the first engagement portion and the second engagement portion, respectively;

a third engaged portion provided at the other of the image carrier unit and the developer carrier unit and including a guide surface to be engaged with the third engagement portion and to guide the third engagement portion;

a first bias member provided on the one end side and configured to bias the developer carrier unit toward the image carrier unit; and a second bias member provided on the other end side and configured to bias the developer carrier unit toward the image carrier unit, wherein a bias direction of biasing the developer carrier unit toward the image carrier unit by the second bias member is inclined with respect to the guide surface of the third engaged portion, and the third engagement portion is located between the first engagement portion and the second engagement portion when viewed in the longitudinal direction.

11. An image formation apparatus comprising the image formation unit according to claim 10.

* * * * *